US006015271A

United States Patent [19]

Boyer et al.

[11] Patent Number: 6,015,271

[45] Date of Patent: Jan. 18, 2000

[54] STOWABLE WALKING BEAM PUMPING UNIT

[75] Inventors: LeMoyne Boyer, Lufkin; Robert Miler Jones, Diboll, both of Tex.

[73] Assignee: Lufkin Industries, Inc., Lufkin, Tex.

[21] Appl. No.: 09/172,400

[22] Filed: Oct. 14, 1998

[51] Int. Cl.[7] ..... F01B 23/08

[52] U.S. Cl. ..... 417/321; 74/41

[58] Field of Search ..... 417/321, 555.2; 74/41, 589, 590, 603

[56] References Cited

U.S. PATENT DOCUMENTS 2,380,686 7/1945 Cummins ..... 74/41
3,175,513 3/1965 Dulaney ..... 74/41
5,105,671 4/1992 Slater ..... 74/41

*Primary Examiner*—Charles G. Freay

[57] ABSTRACT

An improved beam pumping unit for pumping fluids from a well having a foldable support structure to allow storage of the pumping unit in a low profile position. The beam pumping unit utilizes a walking beam pivoted on a central bearing, a drive means connected to one end of the walking beam to oscillate the walking beam and a horsehead at the other end of the walking beam for connection to the polished rod of the downhole pump. A foldable Samson post supports the central bearing of the walking beam. The foldable Samson post allows lowering of the pumping unit from a first, fixed standing position in which the walking beam is raised for normal pumping operation and a second, fixed lowered position for storage.

14 Claims, 4 Drawing Sheets

STOWABLE WALKING BEAM PUMPING UNIT

BACKGROUND OF INVENTION

The present invention relates to beam pumping units and more particularly, walking beam pumping units that are used in producing fluids from wells.

The term beam pumping unit is used to describe a pumping unit in which a walking beam is provided with a bearing support intermediate to its ends. One end of the walking beam is coupled to crank arms by means of pitman arms that are driven by a speed reducer connected to a prime mover to oscillate the walking beam. The other end is provided with a horsehead that is coupled to the polished rod of the well. The downhole pump is connected to the polished rod by means of a rod string. The walking beam reciprocates the connected rod string of the downhole pump to produce fluids from the well. The central bearing of the walking beam is supported by a Samson post which elevates the walking beam to a height sufficient to allow the horsehead to move the polished rod through the complete stroke of the downhole pump.

The height of the pumping unit normally does not create problems in most oilfields since there are no overall height limitations on the pumping unit. There are situations where the height may be an issue, such as irrigated fields, or special shipping and installation requirements where it is desirable to ship the pumping unit assembled. In the case of oilfields located in irrigated agricultural areas, the height of the pumping unit creates problems. This is particularly the case in those irrigated areas that use large sprinkling systems that normally have a clearance under the sprinkling units of approximately 12 ft. or less. Many locations use a sprinkling unit of the type referred to as center pivot irrigation systems in which a long irrigation pipe, for example a ¼ to ½ mile in length, is mounted on elevated wheeled supports. This type of irrigation unit normally has approximately 12 ft. or less of clearance between the irrigation pipe and the ground. Thus, some means are required for lowering the overall height of any pumping units that are located within the irrigated area.

It has been conventional practice when locating pumping units in irrigated areas to dig pits in the irrigated area and mount the pumping unit below the surface of the ground. This will reduce its overall height below the clearance between the irrigation pipe and the ground. While this solves the problem for providing clearance between the pumping unit and the irrigation unit, it introduces the new problem of maintaining the pit free of water. Since many pumping units utilize electric motors and gear type speed reducers to drive the pumping unit, the pit area cannot be flooded. The use of a pit to lower the overall height of the pumping unit also complicates the problem of servicing the pumping unit and well. Pits can also collect debris and hazardous gases, thereby making conditions less safe for personnel.

A possible solution to this problem would be a means to lower the overall height of the pumping unit upon the approach of the irrigation system. Such a system is shown and described in U.S. Pat. Nos. 4,572,012 and 4,788,873. These patents describe a portable beam pumping unit that is trailer mounted and provided with a means for lowering the pumping unit to a height that allows its transport over normal roads. The system described in the above referenced patents requires removal of the mounting means for one leg of the Samson post so that the Samson post can be lowered and thus lower the walking beam. However, when the pumping unit is lowered, the free leg of the Samson post extends below the frame of the pumping unit. An additional problem with the system described in the above patent is that the crank arms used to oscillate the walking beam must be locked in a preset position before the pumping unit can be lowered. This is necessary to prevent the walking beam from contacting other parts of the pumping unit.

The above problems with the prior art render the pumping unit described in the patents unworkable in irrigated fields. For example, the necessity for the rear leg of the Samson post to extend down below the frame of the pumping unit when it is lowered would necessitate the provision of a pit under the pumping unit. Further, the necessity to lock the crank arms in a particular position before lowering the pumping unit and to remove the Samson post mounting means require the attention of a field worker.

Another potential need for a stowable walking beam pumping unit described in the present invention is pre-assembled shipping and simplified installation at the well site. In some remote well locations, pumping unit assembly equipment and trained people might not be easily attainable. In this situation, a pumping unit that could be shipped from the manufacturer in a fully assembled condition would eliminate the need for trained personnel and heavy equipment to rig and assemble the pumping unit at the well site.

BRIEF SUMMARY OF THE INVENTION

The present invention solves the above problems by providing a pumping unit in which the rear support leg of the Samson post is provided with a knee joint. This permits the rear leg of the Samson post to be folded and eliminates the necessity of removing the lower fastening means from the rear support leg when the pumping unit is lowered. In addition, when the rear leg is folded, no portion of the leg extends below the frame of the pumping unit. This eliminates the need for a pit for the rear leg of the Samson post when the pumping unit is lowered.

The present invention also provides a means by which the crank arms of the speed reducer can be allowed to rotate and seek a 6 o'clock position. The pumping unit is provided with means to prevent either the horsehead from contacting the surface on which the unit is mounted or the opposite end of the walking beam from contacting the speed reducer. In particular, depending upon the stroke of the pumping unit, the crank arms may be located up to 40° either side of the 6 o'clock position (crank weights positioned straight down), and still allow the pumping unit to be successfully lowered to a storage position.

An added capability provided is that the pumping unit, while in a folded position, is at its lowest potential energy state and in a stable condition. Indeed the pumping unit automatically balances itself so that the walking beam is supported by the pitman arms and the knee of the rear leg. Thus, it is not necessary to set the brake of the pumping unit or employ other locking means prior to lowering the unit for storage.

In addition, the present invention also provides safety features which insure that the pumping unit cannot be accidentally lowered when the Samson post is raised to its top position to allow operation of the unit. The safety features consist of means for securely latching the knee joint of the rear leg in a fixed upright position and a safety post which prevents folding of the rear leg once it is raised to an upright position. The locking means may be a latch that is spring biased to a locking position and means for moving it to an open position. The safety post must be manually unset to allow the pumping unit to be lowered. The safety post has a means whereby the post is automatically reset to the safe position upon raising the pumping unit.

The folding means provided to lower the pumping unit to the stored position also incorporate safety features which provide for smooth, controlled movement of the massive suspended members, and an immediate termination of the folding operation in the unlikely event of either power loss, or mechanical failure of the folding means.

PREFERRED EMBODIMENT

Figure 1:
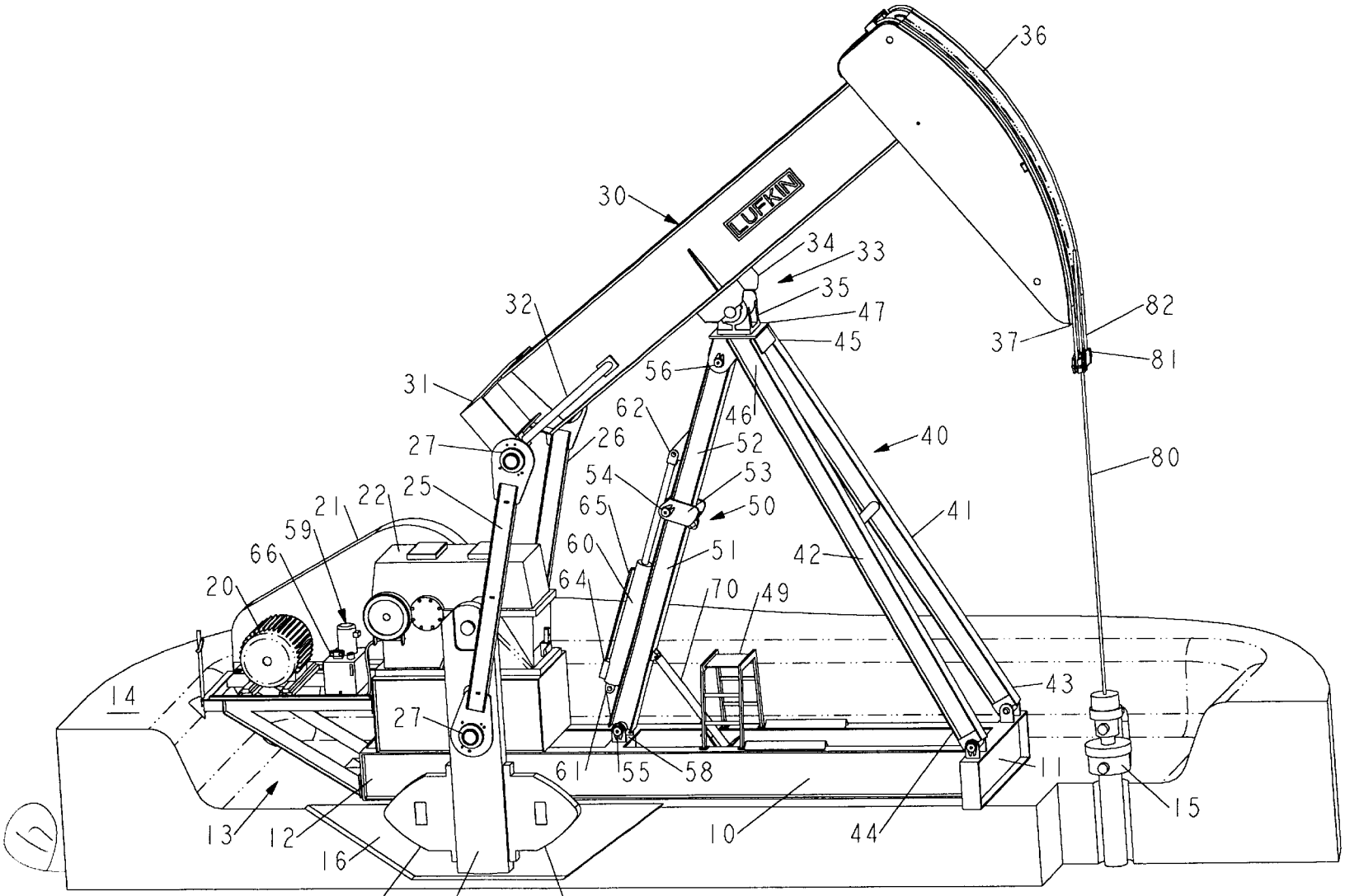
FIG. 1 is a perspective view of the beam pumping unit incorporating the present invention, installed in an oilfield and shown in the upright position for normal pumping operation.
Figure 2:
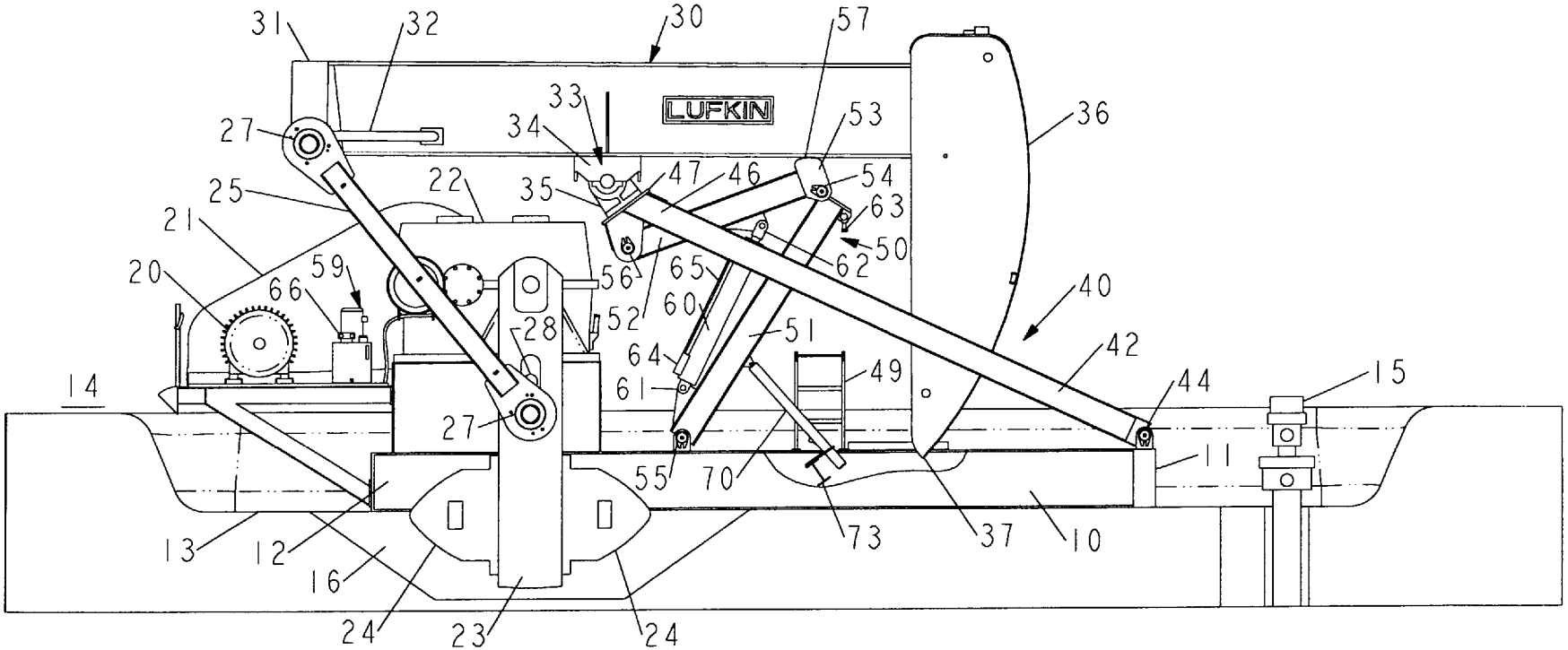
FIG. 2 is an elevation view of the beam pumping unit shown in FIG. 1 in a stored or lowered position with a cutaway revealing the safety leg.

Referring to FIGS. 1 and 2, there is shown the means utilized in the present invention for raising the Samson post and the walking beam to an operating position and lowering the Samson post and walking beam to a storage position. In particular, there is shown a frame 10 of a pumping unit having a forward end 11 and rear end 12. The frame of the pumping unit is mounted on a concrete foundation (not shown) in a pit 13. As shown in the figures, the pit 13 may need to be lowered slightly below the surface of the surrounding ground area 14 depending on the size of pumping unit and local requirements. While the pumping unit is located in a shallow pit below the elevation of the surrounding area 14, the critical components of the pumping unit, i.e. the prime mover 20, the speed reducer 22, and the hydraulic power unit 59 are located above the elevation of the surface 14. Thus, even if the pit area fills with water, it will not cause damage to any of the critical components of the pumping unit. In addition, to the main pit area 13, two additional small pit areas 16 are located on each side of the pumping unit to provide operating clearance for the crank arms 23, if needed.

A conventional drive means consisting of a prime mover 20, shown as an electric motor, a belt drive means 21 and a speed reducer 22, is mounted on the rear end of the frame 10. The speed reducer 22 rotates the crank arms 23 to oscillate the walking beam 30. The crank arms 23 are provided with conventional counterweights 24 whose position may be adjusted to balance the load of the rod string extending into the well 15. The crank arms 23 are coupled to the rear end of the walking beam by means of pitman arms 25 and 26. The lower ends of the pitman arms are coupled to a pin extending from the crank arms by spherical bearings 27 while the upper end of the pitman arms are coupled to a similar pin and spherical bearing arrangement 27 which extend from a horizontal crossbeam 31 of the walking beam 30. The horizontal crossbeam 31 is braced against movement by means of two strut braces 32 that are attached to the walking beam 30 at one end and the horizontal crossbeam 31 at the other end. The use of the pin and spherical bearing arrangement 27 at both ends of the pitman arms 25, 26 provides a means for allowing the pumping unit to self-align without the necessity of the complicated bearing arrangements found in conventional beam pumping units. The elimination of the complicated bearing arrangements of prior units permits the pitman arms 25, 26 to be coupled to the walking beam 30 above the lower surface of the walking beam 30 to further reduce the overall height of the pumping unit when it is lowered to a stored position.

The walking beam 30 is supported by a central bearing 33 located intermediate to the two ends of the walking beam at approximately the center of the walking beam. The bearing consists of a saddle 34 that is attached to the lower surface of the walking beam 30 and a central or fixed bearing member 35 secured to a plate 47 on the top of the Samson post 40. The fixed portion 35 of the central bearing 33 may consist of tapered roller bearings. The forward or front end of the walking beam 30 is provided with a conventional horsehead 36 with the horsehead being coupled to the polished rod 80 by means of conventional wireline cable 82 and carrier bar 81.

The Samson post has two forward legs 41 and 42 whose lower ends 43 and 44 are rotatably attached to the front end 11 of the frame 10. The upper ends 45 and 46 of the forward legs are secured by welding or the like to the plate member 47 that supports the fixed portion 35 of the central bearing 33.

The third or rear leg 50 of the Samson post is provided with a lower portion 51 and an upper portion 52 that are joined together by a knee joint 53. As shown particularly in FIG. 2, the knee joint 53 utilizes a pivot pin 54 that is located off the centerline of the rear leg 50 when it is raised to an upright position. This insures that the load on the rear leg 50 will maintain the rear leg 50 in a locked upright position when raised and the weight of the upper members applied. The lower end 55, of the lower portion of the rear leg 51 is pivotally coupled to a crossbeam 58 of the frame 10 while the upper end 56 of the upper portion of the rear leg 52 is pivotally coupled to the plate member 47. Prior to folding the rear leg 50, the carrier bar 81 is disconnected from the polished rod 80 of the well 15 in a conventional manner.

The rear leg 50 is moved between an upright position as shown in FIG. 1 to a folded position as shown in FIG. 2 by means of a hydraulic cylinder 60. An alternative means to the hydraulic cylinder may comprise of a pneumatic cylinder or a powered screw. The hydraulic cylinder 60 is coupled to the lower portion 51 of the rear leg 50 at the lower connection 61 and to the upper portion 52 of the rear leg 50 at the upper connection 62.

Figure 4:
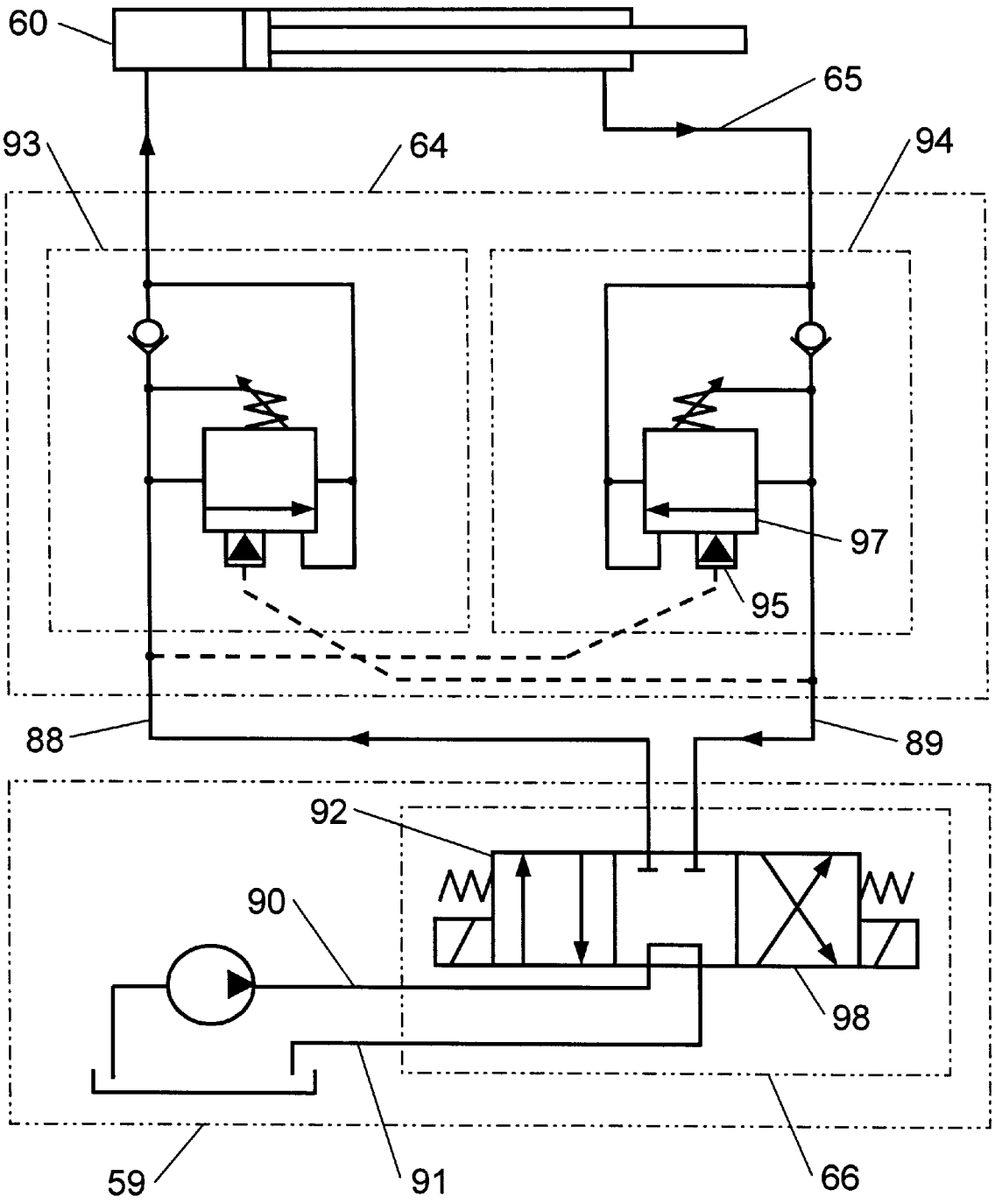
FIG. 4 is a schematic of the hydraulic system of the beam pumping unit shown in FIGS. 1 and 2.

The hydraulic cylinder 60 incorporates a safety control means comprising a dual counterbalance valve arrangement 64 which is mounted directly to the hydraulic cylinder 60. The current design may utilize load control valves of the CB (counterbalance) series manufactured by Sun Hydraulics Corporation, of Sarasota, Fla. The dual counterbalance valve arrangement 64 is directly ported to the blind end of the hydraulic cylinder 60 and is permanently piped to the rod end of the hydraulic cylinder 60 by means of steel tubing 65. Supply and return hoses and tubing 88, 89 shown in FIG. 4 are provided between the directional control valve 66 of the hydraulic power unit 59 and the dual counterbalance valve arrangement 64 to transmit the hydraulic fluid required to extend or retract the hydraulic cylinder 60. Electrical signals are supplied to the solenoid operated directional control valve 66 to operate the hydraulic power unit 59 to extend or retract the hydraulic cylinder 60.

The purpose for the dual counterbalance valve arrangement 64 is two-fold. First, it serves to provide maximum safety in the event of power loss or hose breakage and will stop the movement of the hydraulic cylinder 60 and hold the gravity load of the Samson post 40, walking beam 30, horsehead 36 and other suspended members. This is possible due to the design of the dual counterbalance valve arrangement 64 and the fact that it is permanently mounted directly to the hydraulic cylinder 60.

Second, the dual counterbalance valve arrangement 64 provides smooth and precise motion control when negative, or overrunning, load conditions occur. This valve arrangement provides a means which assures that the directional control valve 66 always sees a positive load pressure. Initially as the hydraulic cylinder 60 is extended to raise the pumping unit, a positive resistive load pressure exists in the blind end of the hydraulic cylinder 60. However, due to the geometric arrangement of the rear Samson post leg 50 and the offset knee joint pivot pin 54, the load in the blind end of the hydraulic cylinder 60 changes from resistive to overrunning just before the fully raised position is reached, or in other words the load pressure becomes negative in the blind end of the hydraulic cylinder 60. If the dual counterbalance valve arrangement 64 was not present, a vacuum would exist in the hydraulic power unit 59, and could cavitate the pump (not shown) in the hydraulic power unit 59 or draw air through seals, either of which would cause uneven and unsafe motion of the assembly. Due to the internal cross-pilot design of the dual counterbalance valve arrangement 64, a positive pressure from the hydraulic power unit 59 is always required to extend and retract the hydraulic cylinder 60, regardless of the applied load to the hydraulic cylinder ends 61, 62.

Referring to FIG. 4, there is shown the hydraulic connections between the dual counterbalance valve arrangement 64, the hydraulic cylinder 60 and the hydraulic power unit 59. FIG. 4 utilizes standard fluid power symbols for the various components and flow line arrows show the fluid flow direction to extend the cylinder 60 to raise the beam pumping unit to its operating position. The directional control valve 66 is shown in the center or neutral position such that the hydraulic pump supply 90 is circulated back to the reservoir of the power unit through the return line 91. When the cylinder 60 is to be extended, the block 92 is moved to the right to connect the supply of the power unit 59 to the blind end of cylinder 60. Movement of the block 92 also connects the upper end of cylinder 60 to the return line 91. The dual counterbalance valve arrangement uses two load control valves 93 and 94. As shown, both valves are in the rest position such that flow through the valve is blocked. When the block 92 of control valve 66 is moved to the right, hydraulic pressure is transmitted through the supply hose and tubing 88 and applied to the cross pilot assist 95 of the load control valve 94. The hydraulic pressure will overcome the force of the bias spring 96 and move the flow control means 97 of load control valve 94 to connect the line 65 to the return hose and tubing 89 and on to the pump return line 91. This will allow the power unit 59 to extend the cylinder 60 to raise the pumping unit to an operating position.

As explained above, as the pumping unit is raised, the rear leg 50 of the Samson post will reach an over center position, allowing the cylinder to overrun the hydraulic pressure extending the cylinder 60. This will lower the pressure in the blind end of the cylinder 60. The lower pressure when supplied to the cross pilot assist 95 will be insufficient to open the load control valve 94 and it will close. When the load control valve 94 closes, the draining of the upper end of the cylinder 60 will terminate. This condition will continue until the hydraulic pressure builds up in the blind end of the cylinder 60 sufficient to overcome the bias spring 96 and re-open the load control valve 94. Thus, the cylinder 60 will be extended in a controlled manner under all conditions.

When it is desired to retract the cylinder 60 and lower the pumping unit to a stored position, the block 98 of the directional control valve 66 is moved to the left. This will connect the discharge side of the power unit 59 to the rod end of the cylinder 60 and the blind end of the cylinder 60 to the return line 91. The load control valve 93 will control the retracting of the cylinder 60 in the same manner that load control valve 94 controlled the extending of the cylinder. Thus, the lowering of the pumping unit to a stored position will be completely controlled.

The load control valves 93 and 94 will also prevent accidental movement of the cylinder 60 if the hydraulic lines 88, 89 connecting the power unit to the dual counterbalance valve 64 rupture. If either the discharge or return line of the power unit ruptures, the appropriate load control valve 93 or 94 will move to a closed position. This will secure the cylinder in position and prevent injury to personnel or damage to the pumping unit.

Referring now to FIG. 2 where the pumping unit is shown in a lowered or stored position, it should be noted that the upper surface 57 of the knee joint 53 is provided with a curved surface. This allows the walking beam to rest on the curved surface when the hydraulic cylinder 60 is lowered into its extreme retracted position as shown. This further allows the crank arms 23 to be displaced from the six o'clock position while insuring that the lower end 37 of the horsehead does not contact the surface 13. Also, it insures that the rear portion of the walking beam 30 may be lowered below the horizontal without damaging the speed reducer 22. While the exact limits of displacement of the crank arms 23 from the six o'clock position will vary depending upon the stroke and design of the beam pumping unit, for the pumping unit shown in FIG. 2, the crank arms 23 can be displaced up to 40° on either side of the six o'clock position. The crank arms 23 are provided with additional mounting positions as shown by the opening 28 in FIG. 2 that allows the pumping unit to be adjusted for various length strokes. When the lower pivotal connection 27 of the pitman arms 25, 26 is raised to the shorter crank radius position 28, the tolerance for the crank arm 23 to be off the six o'clock position will remain the same and the overall height of the walking beam 30 in the folded position will also remain approximately the same. This is achieved in the design by adjusting the ratio of the lengths of the upper and lower portions of the rear leg of the Samson post 50, as well as utilizing the retracted internal stop of the hydraulic cylinder 60 if necessary.

The rear leg 50 is provided with a safety latch means which may comprise a swing bolt 63 mounted on the lower portion 51 of the rear leg 50 that is rotated to pass into a slot, not shown in FIG. 2, in the upper portion 52 of the rear leg 50. By tightening the swing bolt 63, the rear leg will be securely locked in an upright position. Other safety latch means such as a spring-loaded latch may be used in place of the swing bolt. A small platform ladder 49 is located on the frame 10 to facilitate access to the swing bolt 63.

Figure 3:
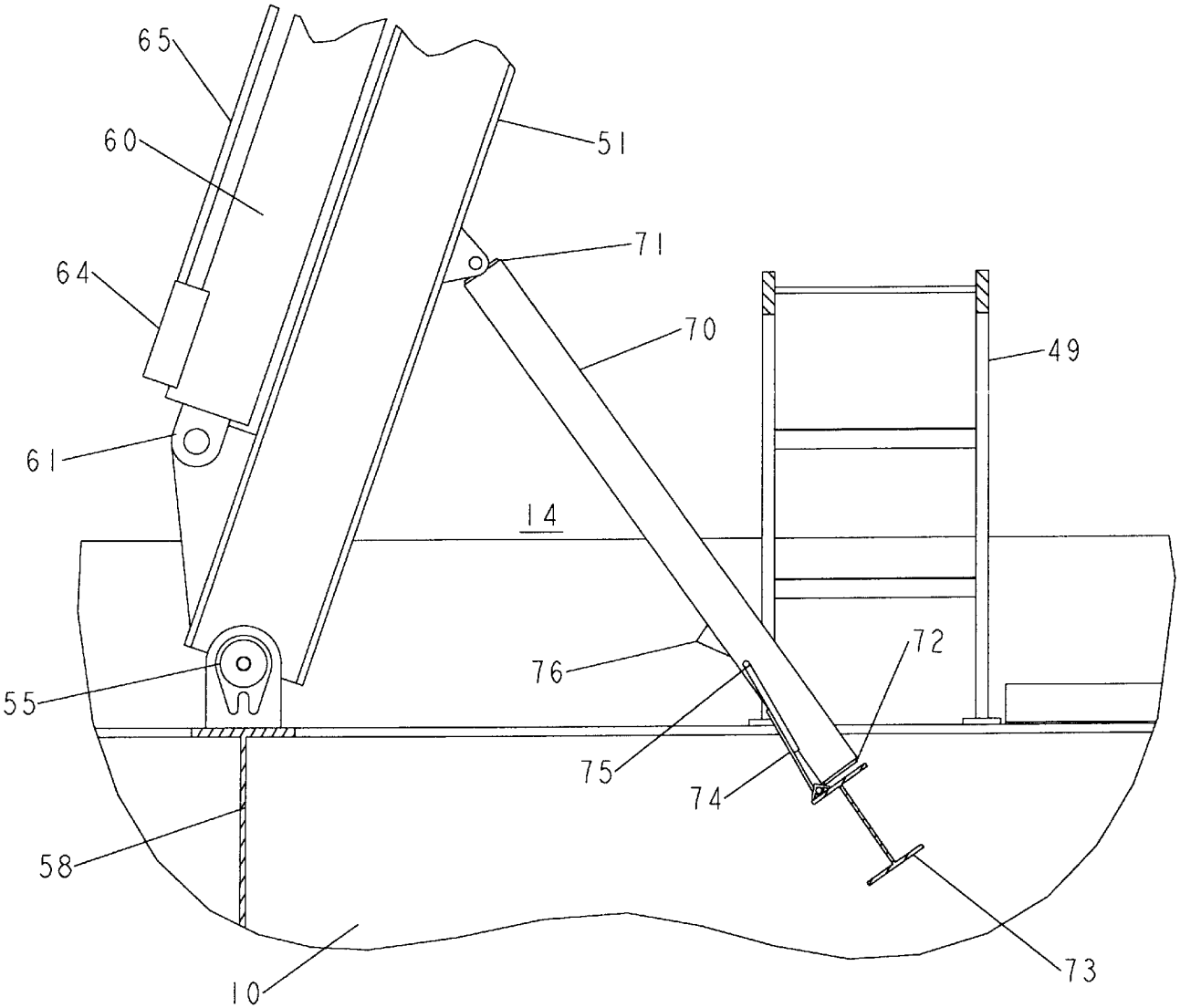
FIG. 3 is a partial elevation view of the beam pumping unit in the upright position showing the safety leg which prevents the accidental folding of the rear leg of the Samson post once it is extended to an upright position.

Referring to FIG. 3, there is shown an elevation view of a portion of the beam pumping unit from FIG. 1 drawn to an enlarged scale. FIG. 3 shows the safety leg 70 that prevents accidental lowering of the pumping unit once the rear leg 50 is moved to an upright position. The upper end 71 of the safety leg is pivotally attached to the forward surface of the lower portion 51 of the rear leg 50 while the lower end 72 of the safety leg rests or is adjacent to the upper surface of the crossbeam 73. Thus when the rear leg 50 is moved to an upright position, gravity will allow the safety leg 70 to fall into a position where the lower end 72 rests or is adjacent to the upper surface of the crossbeam 73 as shown. When it is desired to lower the pumping unit, the lower end of the safety leg is moved off the crossbeam 73 by means of a hinged release 74. A handle 75 is attached to the hinged release 74 to provide additional mechanical advantage to move the leg 70 off the crossbeam 73. It should be noted that when the hinged release 74 is lowered, it will hold the lower end of the safety leg to the side of the crossbeam 73 so that the crossbeam 73 no longer impedes the movement of the lower end 72 of the safety leg 70. This offset position is shown in the cutaway portion of FIG. 2. A pawl 76 shown in FIG. 3 and attached to the safety leg 70 is position such that during the extension cycle of the hydraulic cylinder 60 it engages the hinged safety release 74 to automatically reset the safety post 70 and the hinged safety release 74 to the safe position as shown in FIG. 3.

From the above description of a preferred embodiment, it is seen that the present invention solves the problems of previous beam pumping units that were provided with means for raising them to an operating position and lowering them to a lowered or stored position. In particular, it should be noted that the rear leg 50 of the Samson post 40 is not decoupled from either the frame member 10 or any portion of the Samson post 40. Instead, the rear leg 50 is provided with a knee joint 53 which permits the leg to fold upon itself without requiring any decoupling or disconnecting from the Samson post 40. Also, as described above, when the rear leg 50 is folded as shown in FIG. 2, the knee joint 53 of the rear leg provides support to the walking beam 30, and furthermore, allows the crank arms 23 to be positioned either left or right of the six o'clock position. Thus, there is no necessity for locking the crank arms in a set position prior to folding of the rear leg of the Samson post. The amount of misalignment of the crank arms from the six o'clock position will depend upon the geometry of the system. This allows the drive means of the pumping unit to be shut down and the crank arms to rotate to the six o'clock position by gravity without requiring any setting of brakes to lock them in a particular position. Any misalignment of the crank arms from the six o'clock position can be compensated for after the rear leg of the Samson post is folded and the walking beam is lowered.

The invention in addition incorporates safety features that prevent accidental lowering of the pumping unit once it is raised to an operating position. The safety latch 63 prevents folding of the rear leg 50 once the rear leg is raised to an upright position. While a swing bolt is shown, remotely operated latch means can also be used. The safety leg 70 prevents the lowering of the lower portion 51 of the rear leg 50 once it is moved to an upright position. Operational safety during the folding and raising cycle is provided by means of the dual counterbalance arrangement 64. The arrangement will stop the folding or raising cycle in the unlikely event of power loss or hydraulic hose breakage and provides precise motion control when reversing loads are present.

We claim:

1. A beam pumping unit having a walking beam supported by a central bearing, a Samson post disposed to support the central bearing, a drive means connected to one end of the walking beam to oscillate the walking beam, a horsehead mounted on the other end of the walking beam and connected to the polished rod to reciprocate the polished rod, said Samson post comprising:

a pair of forward support legs, the lower end of each of said support legs being pivotally attached to the frame of the beam pumping unit, the other end of each of said support legs being secured to the central bearing of the walking beam;

a rear support leg, one end of said rear support leg being pivotally attached to the frame of the beam pumping unit, the other end of said rear support leg being pivotally attached to the central bearing of the walking beam, said rear support leg having a knee joint disposed between its ends; and actuating means connected to said rear leg to move said knee joint between a first position in which said rear support leg is fixed in a substantially straight line and a second position in which said rear support leg is bent about said knee joint whereby said walking beam is raised to a first normal pumping position and then lowered to a second storage position.

2. The beam pumping unit of claim 1 and in addition a safety latch disposed to lock said rear support leg in said substantially straight line.

3. The beam pumping unit of claim 2 wherein said safety latch comprises a swing bolt, one end of said bolt being pivotally attached to said rear support leg on one side of said knee joint and the other end of said bolt projecting through an opening on the other side of said knee joint.

4. The beam pumping unit of claim 1 and in addition the pivot of said knee joint being displaced from the centerline of said rear leg.

5. The beam pumping unit of claim 1 wherein said actuating means comprises a hydraulic cylinder, one end of said cylinder being attached to said rear support leg on one side of said knee joint the other end of said cylinder being attached to said rear support leg on the other side of said knee joint.

6. A beam pumping unit for actuating a downhole pump comprising:

a horizontal frame having a front and rear end;

a drive means mounted on said frame, said drive means including a rotary propulsion means coupled to a speed reducer for driving a pair of rotating crank arms;

a walking beam, said walking beam being supported intermediate to its ends by a central bearing; one end of said walking beam being connected to said rotating crank arms by means of a pair of pitman arms, the other end of said walking beam having a horsehead, said horsehead being coupled to the polished rod of the downhole pump;

a Samson post mounted on the front of said frame and disposed to support the central bearing of the walking beam, said Samson post having a pair of front legs, the lower end of each front leg being pivotally connected to the front of said frame, the upper ends of said front legs being attached to said central bearing; said Samson post in addition having a rear leg, said rear leg having a knee joint disposed intermediate to the ends of the rear leg, the lower end of the rear leg being pivotally attached to the frame member and the upper end being pivotally attached to said central bearing; and an actuating means coupled to said rear leg for moving said knee joint between a first position in which said rear leg is disposed in a fixed standing position in which the walking beam is raised for a normal pumping operation and a bent position in which the walking beam is lowered to a storage position.

7. The beam pumping unit of claim 6 wherein said actuating means comprises a hydraulic cylinder.

8. The beam pumping unit of claim 6 and in addition a safety latch for preventing bending of said knee joint when said rear leg is in said first position.

9. The beam pumping unit of claim 8 wherein said safety latch comprises a swing bolt pivotally secured to one portion of the rear leg and engaging an opening in the other portion of the rear leg.

10. The beam pumping unit of claim 6 and in addition a safety leg attached to the lower portion of the rear leg and disposed in a position to prevent movement of the lower portion of the rear leg when the walking beam is raised to an operating position.

11. The beam pumping unit of claim 5 and, in addition, a safety control means coupled to said hydraulic cylinder to prevent uncontrolled movement of the hydraulic cylinder.

12. The beam pumping unit of claim 11 wherein said safety control means comprises a dual counterbalanced valve arrangement that is disposed to prevent uncontrolled flow of hydraulic fluid from the hydraulic cylinder.

13. A beam pumping unit having a walking beam supported by a central bearing, a support means disposed to support the central bearing, a drive means connected to one end of the walking beam to oscillate the walking beam, a horsehead mounted on the other end of the walking beam and connected to the polished rod to reciprocate the polished rod, the improvement comprising:

a hydraulic cylinder coupled to the support means to lower said support means to reduce the overall height of the pumping unit and raise said support means to raise the pumping unit to an operating position; and a safety control means coupled to said hydraulic cylinder to prevent uncontrolled movement of the hydraulic cylinder.

14. The beam pumping unit of claim 13 and, in addition, a support means comprising a Samson post having a movable leg for moving said support means between said lowered and raised positions.

* * * * *